US006991560B2

(12) United States Patent
Tseng

(10) Patent No.: US 6,991,560 B2
(45) Date of Patent: Jan. 31, 2006

(54) GOLF CLUB HEAD WITH A VIBRATION-ABSORBING STRUCTURE

(75) Inventor: Wen-Cheng Tseng, 14F, No. 66, Kuanghua 2 Rd., Chienchen Dist., Kaohsiung (TW)

(73) Assignees: Wen-Cheng Tseng, Kaohsiung (TW); Kung-Wen Lee, Kaohsiung (TW)

( * ) Notice: Subject to any disclaimer, the term of this patent is extended or adjusted under 35 U.S.C. 154(b) by 46 days.

(21) Appl. No.: 10/719,368

(22) Filed: Nov. 21, 2003

(65) Prior Publication Data

US 2005/0113185 A1 May 26, 2005

(51) Int. Cl.
*A63B 53/04* (2006.01)
*A63B 53/06* (2006.01)

(52) U.S. Cl. ..... 473/332; 473/346; 473/350

(58) Field of Classification Search ..... 473/324–350
See application file for complete search history.

(56) References Cited

U.S. PATENT DOCUMENTS

| | | | | |
|---|---|---|---|---|
| 4,523,759 | A * | 6/1985 | Igarashi | 473/346 |
| 4,545,580 | A * | 10/1985 | Tomita et al. | 473/332 |
| 5,228,694 | A * | 7/1993 | Okumoto et al. | 473/348 |
| 5,586,948 | A * | 12/1996 | Mick | 473/332 |
| 5,669,827 | A * | 9/1997 | Nagamoto | 473/345 |
| 5,899,821 | A * | 5/1999 | Hsu et al. | 473/332 |
| 6,306,048 | B1 * | 10/2001 | McCabe et al. | 473/333 |

* cited by examiner

*Primary Examiner*—Gregory Vidovich
*Assistant Examiner*—Alvin A. Hunter, Jr.
(74) *Attorney, Agent, or Firm*—Alan D. Kamrath; Nikolai & Mersereau, P.A.

(57) ABSTRACT

A golf club head includes a hollow body with a heel, a toe, a top, a bottom, a strike plate and a rear portion. A recess is defined at the bottom of the body and extends to the rear portion of the body. A strip is integrated with the body covering the recess. A tab is formed at the rear portion of the body, and has an inlet defined through the tab and in communication with the recess. Vibration-absorbing material is injected into the recess through the inlet. A sealing element is engaged in the inlet to enclose the recess.

6 Claims, 9 Drawing Sheets

GOLF CLUB HEAD WITH A VIBRATION-ABSORBING STRUCTURE

BACKGROUND OF THE INVENTION

1. Field of the Invention

The present invention relates to a head for a golf club, and more particularly to a golf club head with a vibration-absorbing structure.

2. Description of Related Art

A conventional golf club head generally has a hollow body which resonates when a player strikes a ball. However, during the striking, the hollow body also has intense vibration that transfers into the player's hands, that may cause an uncomfortable sensation. For absorbing the vibration, the golf club head is usually provided with a vibration-absorbing structure. However, because the vibration-absorbing material cannot survive under the high temperatures that occur during welding, the vibration-absorbing material must be priorly made and received in a recess defined in the hollow body. Thereafter, the recess is covered with a sealing member secured by fasteners under a high pressure.

However, the vibration-absorbing material not only has a high manufacturing cost, it also cannot be tightly adhered in the recess under the high pressure, so the head has an inadequate effect to absorb the vibration.

Therefore, the invention provides a golf club head to mitigate or obviate the aforementioned problems.

SUMMARY OF THE INVENTION

The main objective of the present invention is to provide a golf club head which can effectively absorb vibration during striking of a ball.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
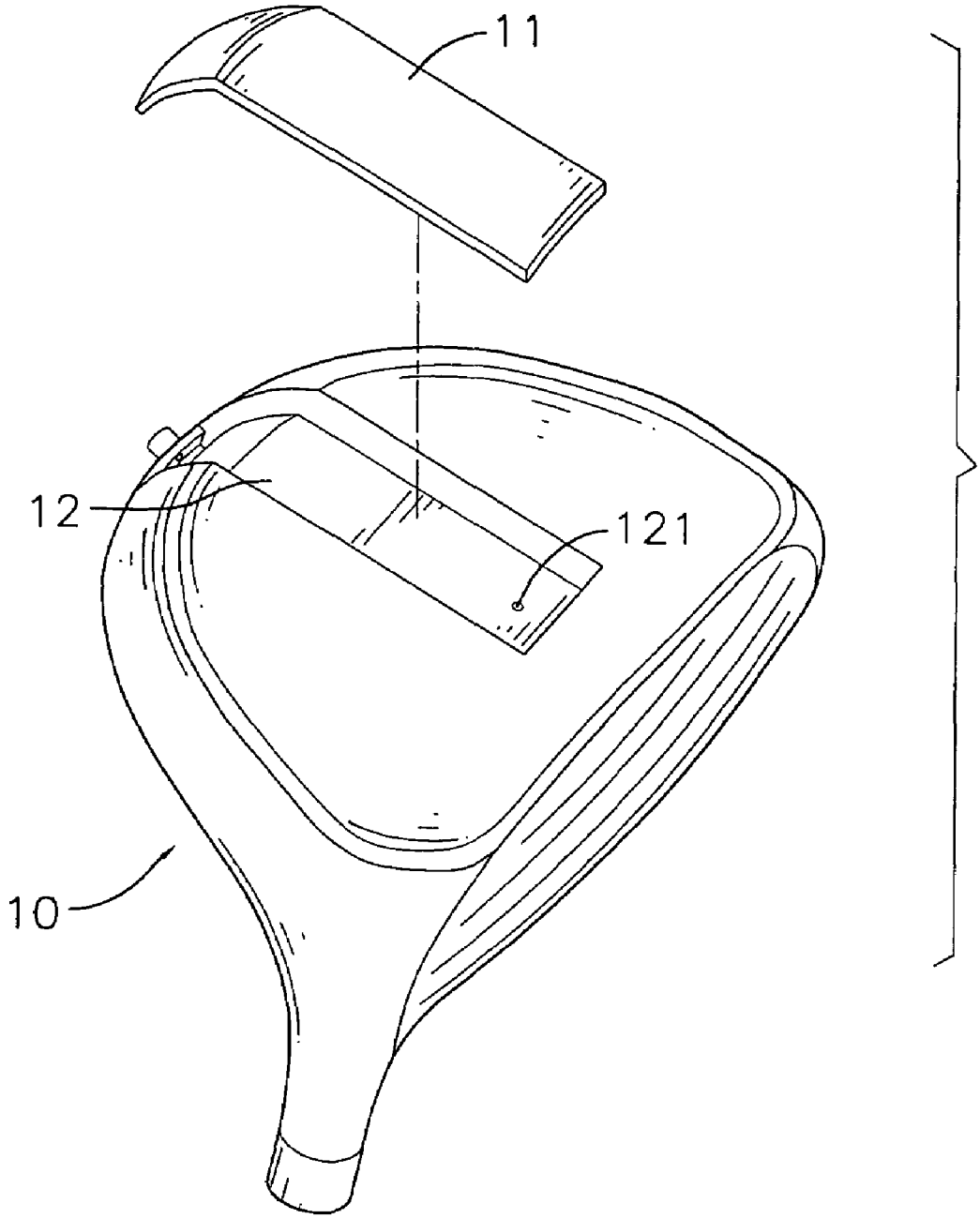
FIG. 1 is an exploded perspective view of a golf club head in accordance with the invention.
Figure 2:
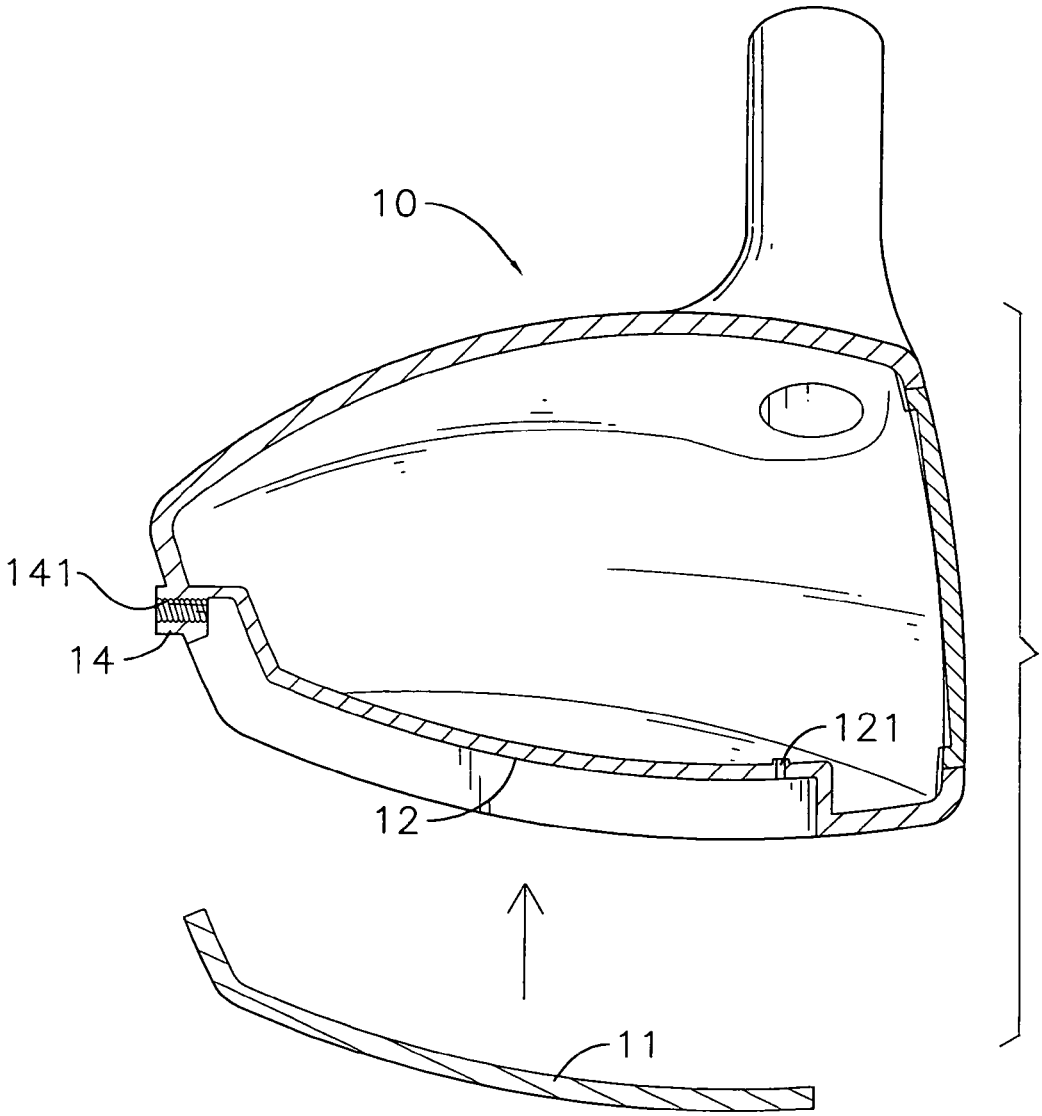
FIG. 2 is a schematically cross sectional view of the golf club in FIG. 1.

With reference to FIGS. 1 and 2, a golf club head (10) in accordance with the present invention has a hollow body with a heel, a toe, a top, a bottom, a strike plate, and a rear portion.

An elongated recess (12), wit an L-like cross section, is defined at the bottom of the body and extends to the rear portion of the body. An aperture (121) is defined through the elongated recess (12) and is in communication with the interior of the body. The elongated recess (12) is covered with an L-like strip (11) integrated with the body by welding. A tab (14) is formed at the rear portion of the body, and an inlet (141) is defined through the tab (14) and is in communication with the recess (12).

Figure 3:
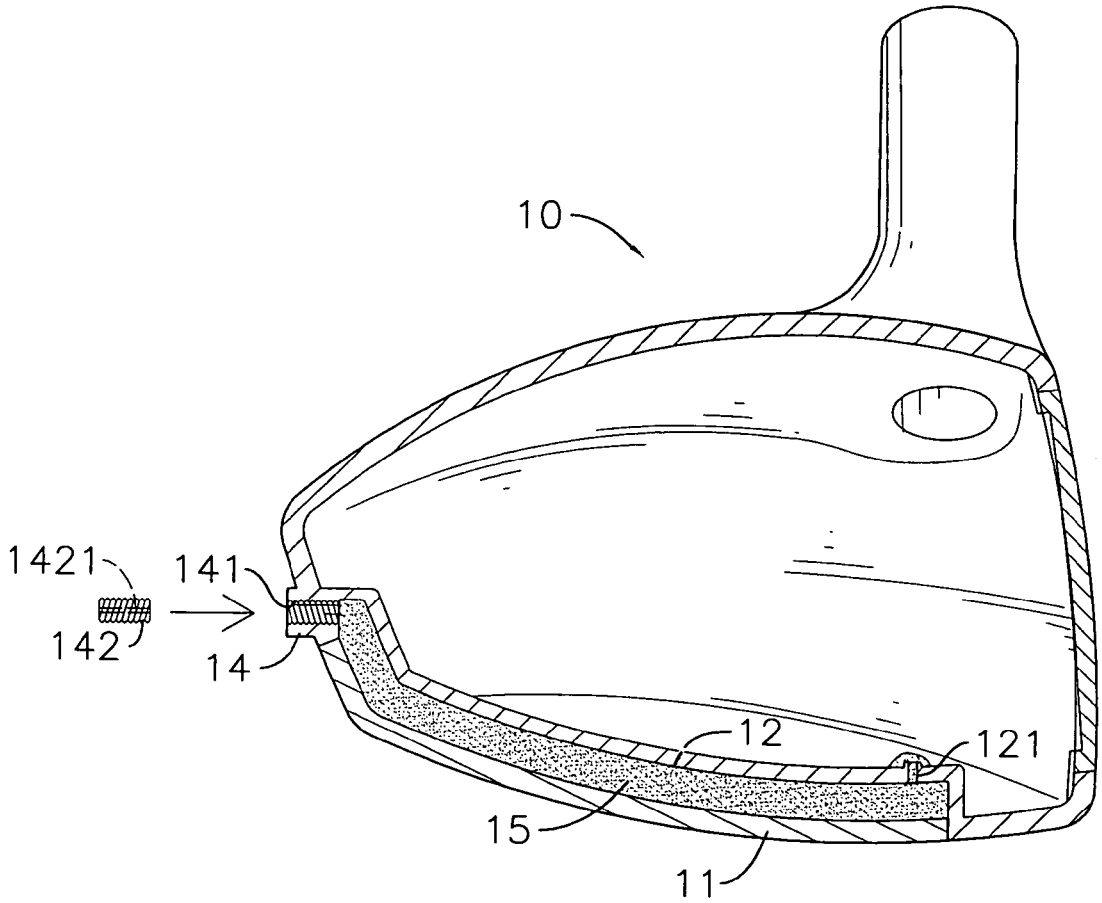
FIG. 3 is a schematically cross sectional view showing a process of injecting vibration-absorbing material into a recess of the golf club head.
Figure 4:
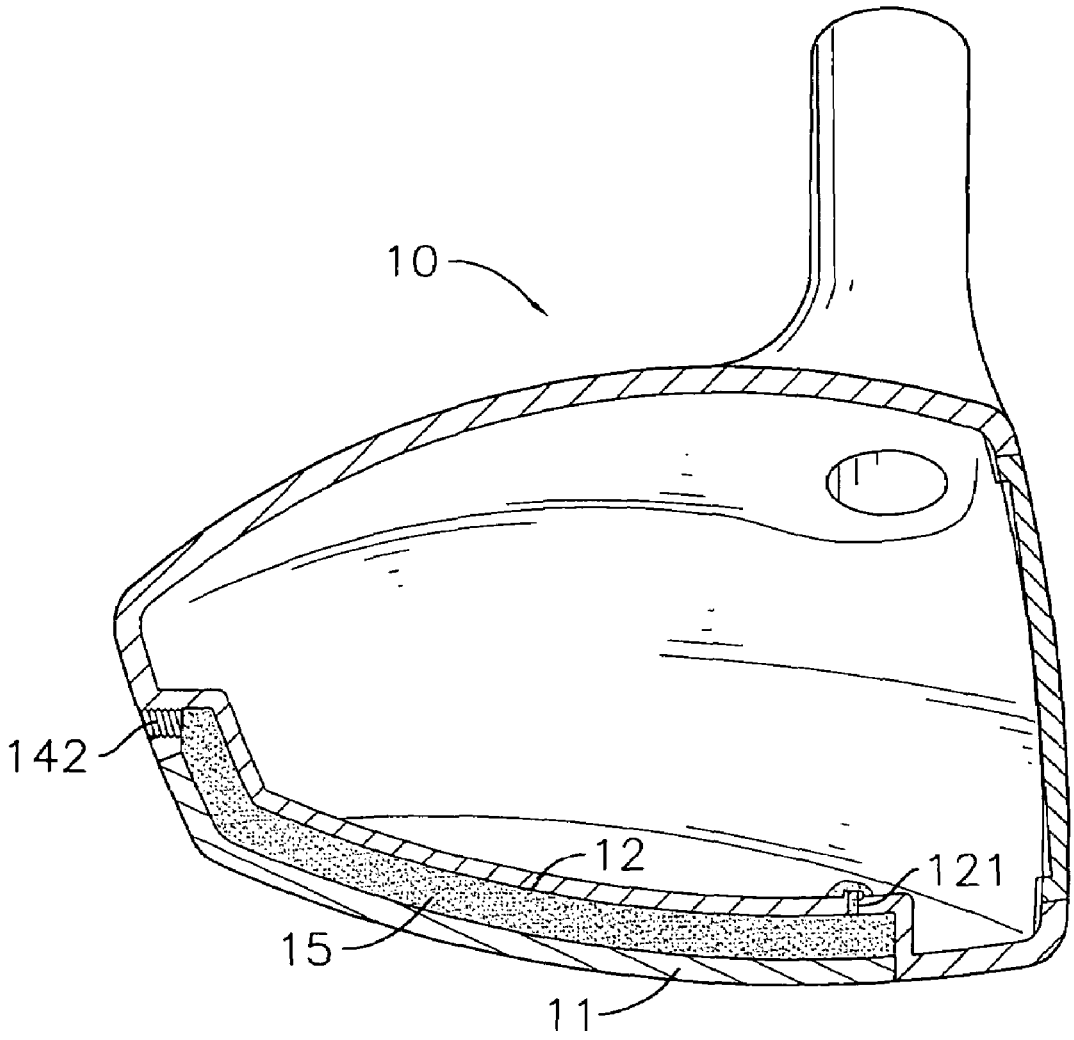
FIG. 4 is a schematically cross sectional view of a finished golf club head of the invention.
Figure 5:
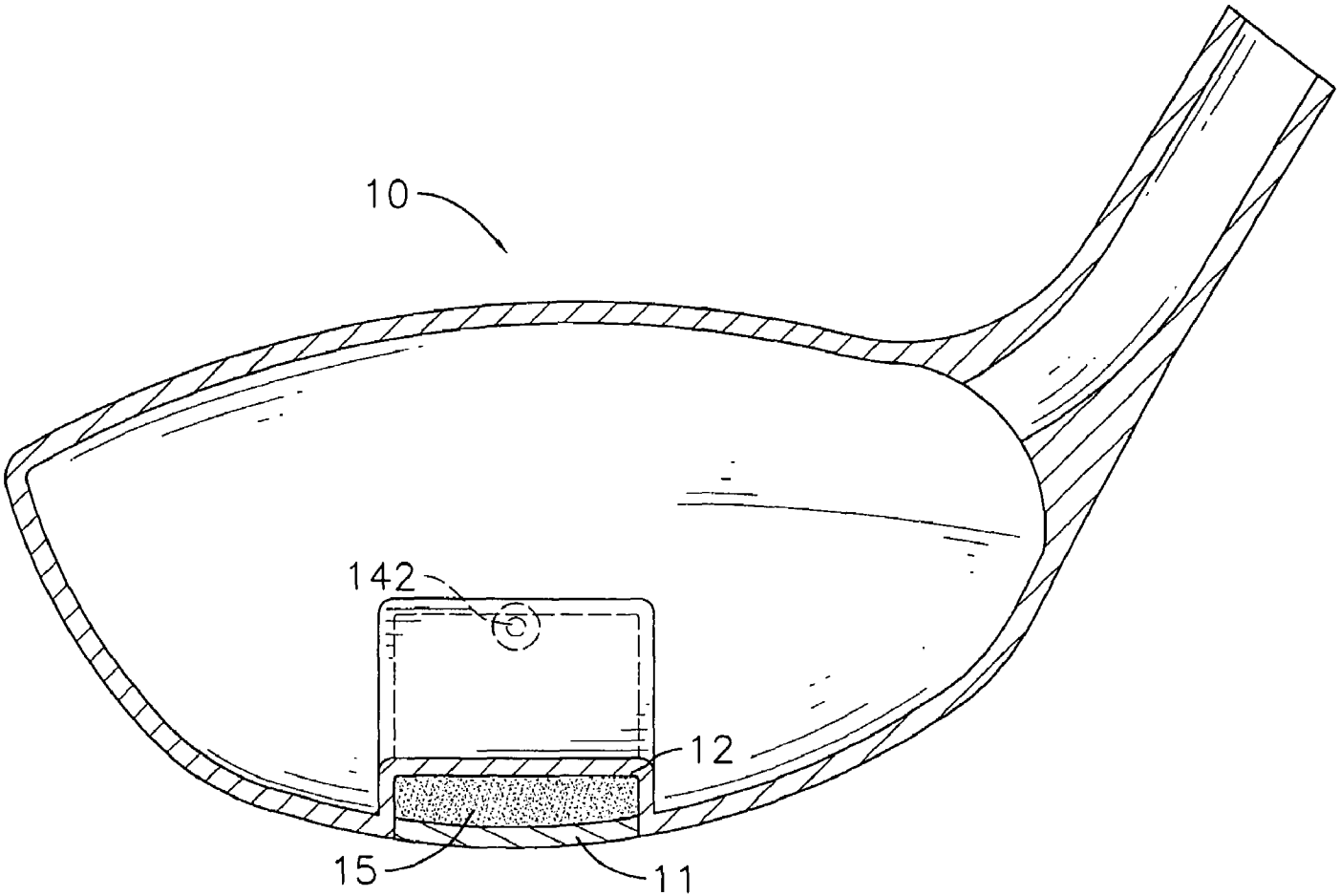
FIG. 5 is a cross sectional front view of FIG. 4.

With reference to FIGS. 3 to 5, the recess (12) is fully filled with vibration-absorbing material (15) through the inlet (141) by injecting, and air in the recess (12) will be discharged from the aperture (121). Thereafter, a sealing element (142) with adhesive is engaged with the inlet (141) for enclosing the recess (12). A passage (1421) is longitudinally defined through the sealing element (142), and the redundant air and adhesive can be discharged from the passage (1421). After the adhesive has solidified, the part of the tab (14) protruded from the rear portion of the body is removed to finish the head (10). Therefore, the head (10) of the present invention can not only have a pleasant impact sound, but also can absorb vibration when a player strikes a ball.

Figure 6:
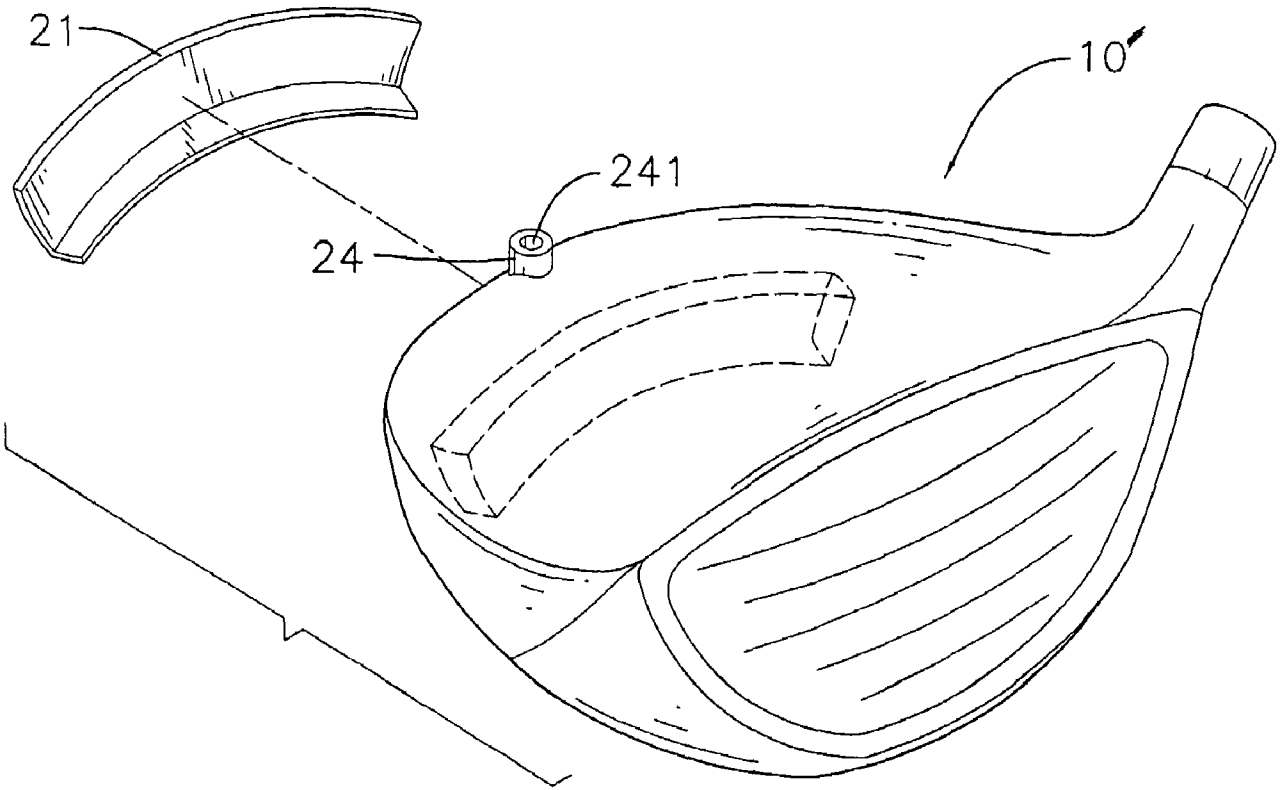
FIG. 6 is an exploded perspective view of another embodiment in accordance with the invention.
Figure 7:
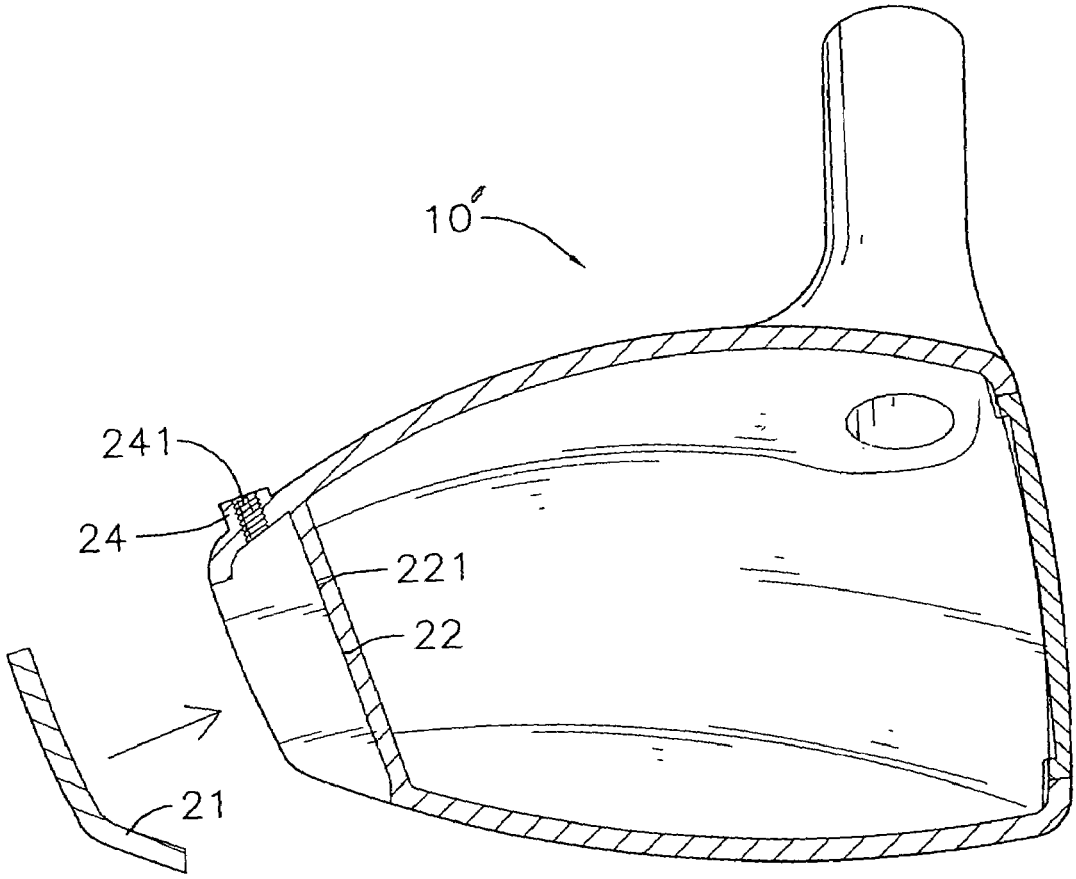
FIG. 7 is a schematically cross sectional view of the second embodiment of FIG. 6.

With reference to FIGS. 6 and 7, in another embodiment of the invention, the head (10') also has a hollow body. A recess (22) is defined at the rear portion of the body and covered with a strip (21) integrated with the body. An aperture (221) is defined through a periphery defining the recess (22) and is in communication with the interior of the body. A tab (24) is formed at the top of the body, and has an inlet (241) defined through the tab (24) and is in communication with the recess (22).

Figure 8:
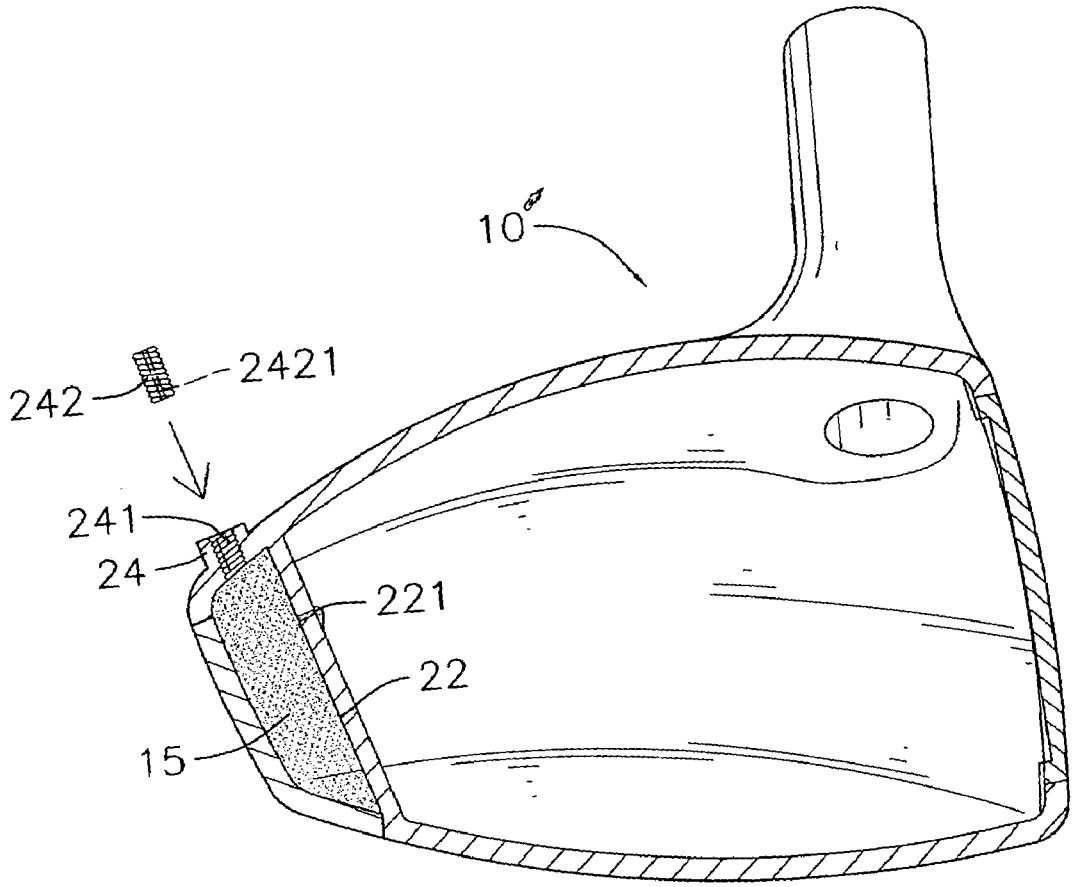
FIG. 8 is a schematically cross sectional view showing the process of injecting vibration-absorbing material into a recess of the golf club head.
Figure 9:
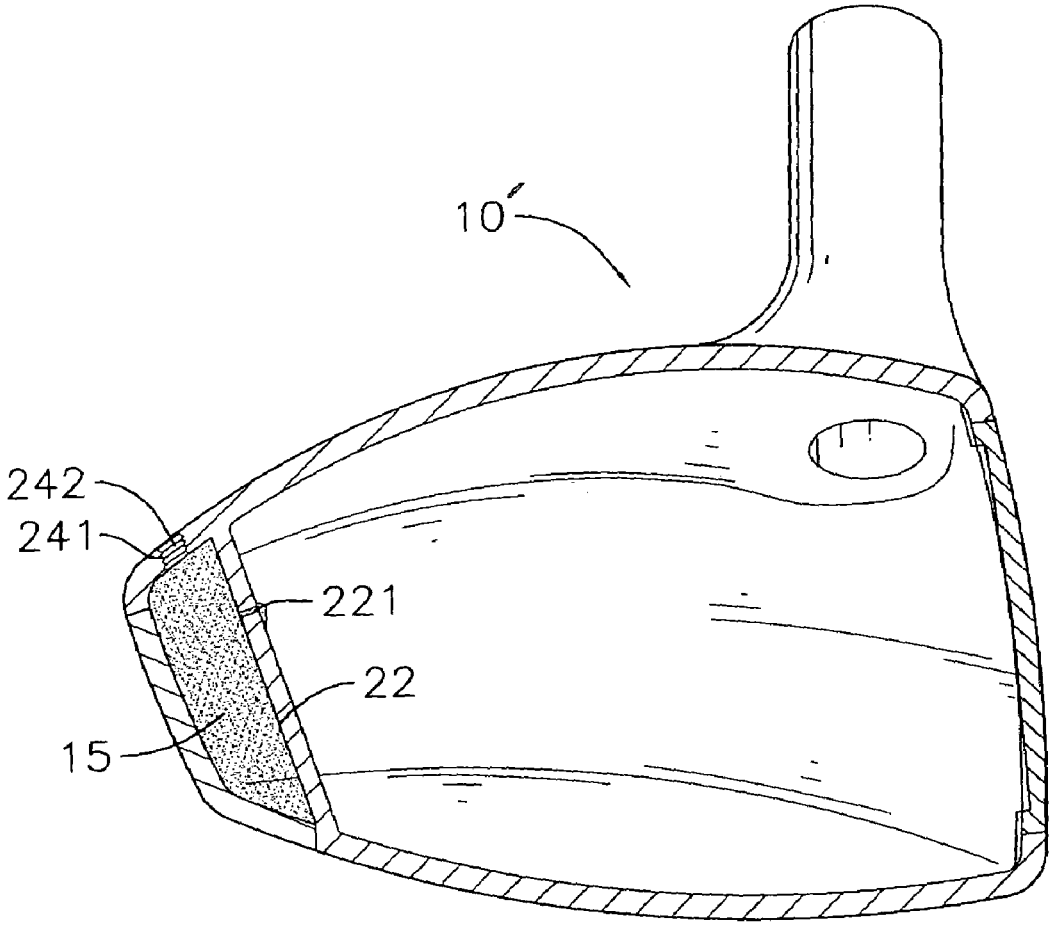
FIG. 9 is a schematically cross sectional view of the finished golf club head of the second embodiment.

With reference to FIGS. 8 and 9, the recess (22) is also fully filled with the vibration-absorbing material (15) through the inlet (241), and air in the recess (22) will be discharged from the aperture (221). Thereafter, a sealing element (242) with adhesive is engaged in the inlet (241) for sealing the recess (22). A passage (2421) is longitudinally defined through the sealing element (242), and the redundant air and adhesive can be discharged from the passage (2421). After the adhesive has solidified, the part of the tab (24) protruded from the rear portion of the body is removed to finish the head (10').

According to the teachings of the invention, it will be known by those skilled in the art that the recess also can be defined at the heel, the toe, the top or other appropriate portions of the body (not shown in these figures), which will not depart from the scope of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A golf club head comprising:

a hollow body with a heel, a toe, a top, a bottom, a strike plate and a rear portion;

a recess defined by a periphery of the body;

a strip integrated with the body and covering the recess;

a tab formed on the body, and having an inlet defined through the tab and in communication with the recess;

vibration-absorbing material injected into the recess through the inlet; and a sealing element engaged in the inlet to close the recess, wherein the periphery defining the recess has an aperture defined therethrough and in communication with the interior of the body.

2. The golf club head as claimed in claim 1, wherein the recess defined by the periphery is at the bottom of the body and extending to the rear portion of the body, with the tab formed at the rear portion of the body.

3. The golf club head as claimed in claim 2, wherein the sealing element has a passage longitudinally defined through the sealing element.

4. The golf club head as claimed in claim 1, wherein the recess defined by the periphery is at the rear portion of the body, with the tab formed at the top of the body.

5. The golf club head as claimed in claim 4, wherein the sealing element has a passage longitudinally defined through the sealing element.

6. The golf club head as claimed in claim 1, wherein the sealing element has a passage longitudinally defined through the sealing element.

* * * * *